US005647305A

United States Patent [19]

Mulshine et al.

[11] Patent Number: 5,647,305

[45] Date of Patent: Jul. 15, 1997

[54] RESETTABLE COOLANT ADDITIVE MAINTENANCE SENSOR

[75] Inventors: Brian W. Mulshine, Carol Stream; Edward H. Howell, III, Wheaton; Alan P. Haag, Western Springs, all of Ill.

[73] Assignee: Navistar International Transportation Corp., Chicago, Ill.

[21] Appl. No.: 631,400

[22] Filed: Apr. 12, 1996

[51] Int. Cl.[6] ..... F01P 5/14

[52] U.S. Cl. ..... 123/41.15; 204/404

[58] Field of Search ..... 123/41.15; 73/61.61; 422/53; 324/555, 556, 71.2; 204/404

[56] References Cited

U.S. PATENT DOCUMENTS 3,410,764 11/1968 Johnson et al. ..... 204/404
4,147,596 4/1979 Baboian et al. ..... 123/41.15
4,338,959 7/1982 Krueger ..... 123/41.15

FOREIGN PATENT DOCUMENTS 6-257431 9/1994 Japan ..... 123/41.15

OTHER PUBLICATIONS

"Prevent Cavitation" Brochure No. CGE 445, Navistar International Transportation Corp., 1991.

*Primary Examiner*—Noah P. Kamen
*Attorney, Agent, or Firm*—Dennis K. Sullivan

[57] ABSTRACT

An engine coolant additive sensor comprises two sections, each made of dissimilar metals which have a single point of contact therebetween. A closed circuit is formed through this point of contact and such point is placed into the engine coolant. When additives become depleted in the coolant, corrosion of one metal takes place breaking the closed circuit and creating an indication that coolant additive maintenance is required. Once maintenance is performed, the point of contact is reestablished, resetting the circuit.

15 Claims, 1 Drawing Sheet

RESETTABLE COOLANT ADDITIVE MAINTENANCE SENSOR

BACKGROUND OF THE INVENTION

The present invention relates to cooling systems for vehicle engines and, more particularly, to a sensor which can be incorporated into a cooling system to sense and advise that engine coolant additives are needed.

THE PRIOR ART

It is known that the chemical composition of engine coolant changes throughout the life of the coolant. Long term studies indicate that over 40% of engine problems are either directly or indirectly related to improper coolant formulation or to inadequate maintenance of various coolant additive(s). Coolant additive(s) provide for buffering by controlling Ph and neutralizing acids; they deter foaming of the coolant; they provide general corrosion protection, and cavitation erosion protection; they act as a scale inhibitor to preventing deposits on hot surfaces; and they act as anti-fouling agents thereby limiting oil and dirt build-up on metal surfaces. As the additive(s) becomes depleted during the life of the coolant, corrosion by and acid buildup in the coolant become more prevalent.

SUMMARY OF THE INVENTION

Accordingly, it is a primary object of the sensor of the present invention to produce an alert that coolant additive(s) need to be replenished.

Such object is met by the sensor of the invention which comprises two sections made of dissimilar metals with an area of contact therebetween. A closed circuit is formed through the contact area. The contact area will be located in the coolant and one of the metals will act as a sacrificial corrosion point, which, when corroded away due to additive depletion, will open the circuit to advise that coolant/additive maintenance is necessary. The sensor is also resettable, so that numerous actuations can be accommodated by a single sensor.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
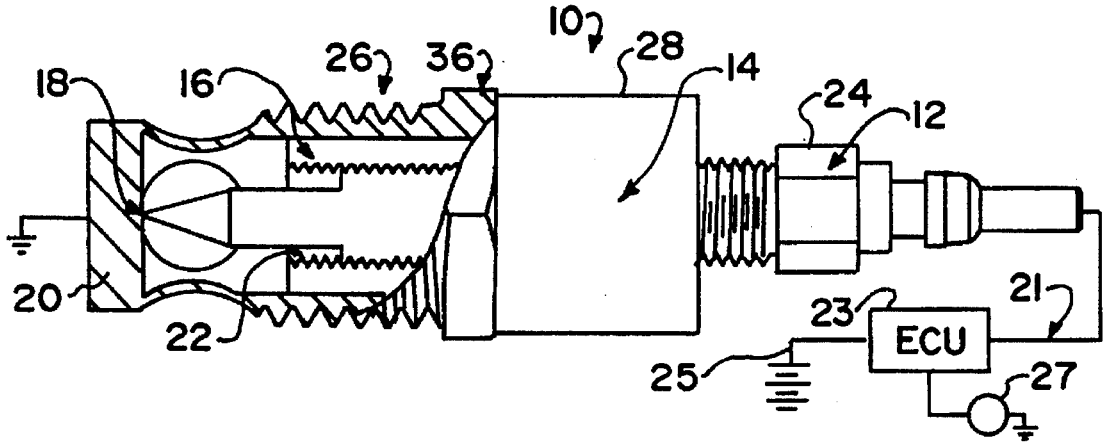
FIG. 1 is a perspective view of the sensor of the invention with a portion broken away to show an intact point of contact therein.

Referring now to the drawings in greater detail, there is illustrated therein the resettable sensor for indicating depleted engine coolant additives made in accordance with the teachings of the present invention and generally identified by the reference numeral 10.

As shown, the sensor 10 is made of two primary components. One is a threaded metal pin 12 and the other is a hollow cooperating metal sleeve 14 having a diametral wall

20 at one end. An insulator in the form of an internally-threaded nylon insert 16 is disposed within the sleeve 14 and is secured therein by a press fit or an adhesive. The pin 12 is threaded into the nylon insert 16 and may be adjustably secured therein by a light interference between the threads or, if desired, by a stop nut (not shown). The nylon insert 16 keeps the pin 12 from contacting the sleeve 14 along the length thereof.

In a preferred embodiment, the pin 12 is made of an easily corroded metal, such as magnesium, while the sleeve 14 is made of a harder metal, such as brass. A further requirement is that each of the metals be capable of carrying a current.

In this respect, it is proposed that sensor 10 be incorporated into a conventional microprocessor-controlled electronic circuit 21 shown schematically in FIG. 1 wherein the pin 12 of sensor 10 is connected to engine control unit 23 which is supplied power from battery 25. The sleeve 14 of sensor 10 acts as a ground for the circuit 21, with the pin 12 making contact with end wall 20 leading to ground. The pin 12 is shown to have a point 18 at one end thereof, with the pin point 18 being placed in direct contact with the end wall 20 of the brass sleeve 14, to create a complete, closed circuit. It will be understood that the circuit is opened if the sleeve wall 20 and pin point 18 lose contact. When the engine control unit 23 senses that the circuit 21 is no longer grounded, it is programmed to switch on an indicator lamp 27 on the vehicle dashboard or otherwise indicate a failure of the circuit.

Contact may be created between the pin point 18 and sleeve wall 20 by turning of the pin 12, engaged within the threaded bore 22 through the nylon insert 16. Such turning can be accomplished by engaging a free end 24 of the pin 12, which can be provided with an engageable member such as a screw head or nut head 24 as shown here, and moving the pin 12 forward until the circuit is found to again be complete.

It will be seen that the sleeve 14 is provided with an exterior threaded portion 26. Such threaded portion is provided so the end wall 20 of the sleeve 14 and pin point 18 can be seated within a cooling system flow path, by merely screwing the sleeve 14 into a threaded bore 30 in a wall 32 defined within the cooling system, such as a radiator wall 32, the pin point 18 being positioned to be in constant contact with the coolant and any additive(s) therein. Contact between the pin point 18 and the coolant within which it is placed is assured by providing transversely oriented throughbores 34 in the sleeve 14 just proximal to the end wall 20 thereof, so that coolant can freely pass over the point 18 of the pin 12. It will be understood that the outer surface 28 of the sleeve 14 is provided with structure 36 thereon which is engageable by a tool for screwing the sleeve 14 into the threaded bore 30.

Figure 2:
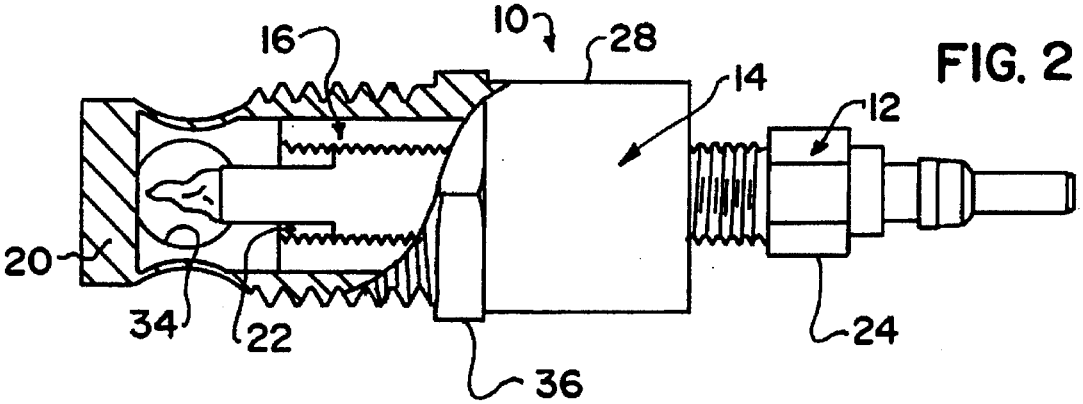
FIG. 2 is similar to FIG. 1 but shows the point of contact destroyed.
Figure 3:
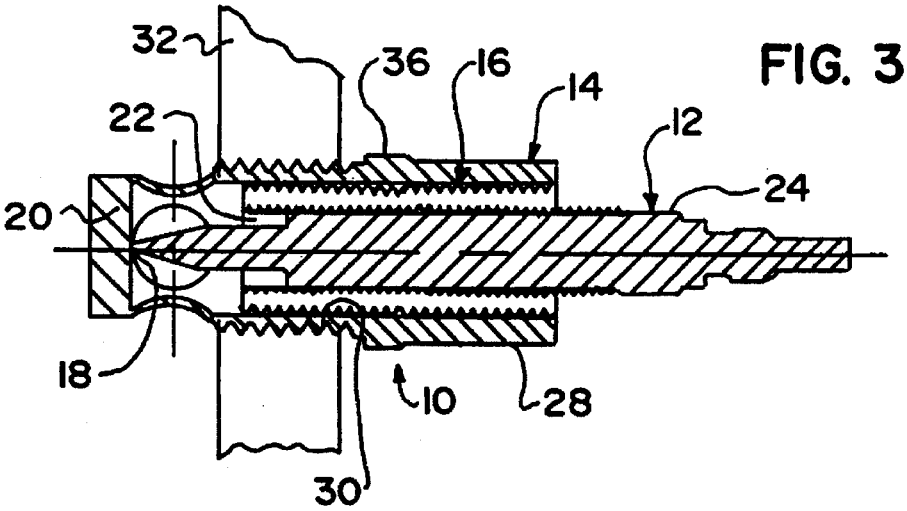
FIG. 3 is a cross section through the sensor and a coolant retaining wall in which it is seated, so that the contact point is being acted on by coolant contained within the vehicle radiator or other area of the engine cooling system.

As stated hereinbefore, when the coolant changes chemically and the additives reach a specific point of depletion, the coolant becomes corrosive. Thus, with the pin point 18 seated within the coolant environment, once a corrosive level is reached within the coolant, the magnesium pin point 18 gradually becomes corroded until contact with the end wall 20 of the sleeve 14 is broken, as shown in FIG. 2, opening the circuit 21 and triggering the engine control unit to light lamp 27 and indicate that engine coolant maintenance is required.

Once maintenance is performed, with the corrosion potential of the coolant being once again decreased by addition of coolant additive(s), the pin point 18 is once again placed into contact with the end wall 20 by turning of the screw threaded pin 12 to reset the circuit 21 to a closed condition.

As described above, the coolant maintenance sensor of the invention provides a number of advantages some of which have been described above and others of which are inherent in the invention. Also, modifications can be made to the sensor without departing from the inventive teachings herein. Accordingly, the scope of the invention is only to be limited as necessitated by the accompanying claims.

What is claimed is:

1. A sensor for indicating when coolant additives are needed in an engine cooling system, the sensor comprising a hollow sleeve of conductive metal within which a non-conductive threaded insert is seated and further within which a threaded conductive metal pin is engaged within and to the insert, the pin and sleeve coming in contact with each other at a single point, with such point of contact being placed within the coolant stream of the engine cooling system, said point of contact creating an electrical contact between the pin and the sleeve which may be broken upon corrosion of the contact point occurring as coolant additives become depleted.

2. The sensor of claim 1 wherein said sleeve is made of a hard metal.

3. The sensor of claim 2 wherein said sleeve is made of brass.

4. The sensor of claim 1 wherein said pin is made of a soft metal.

5. The sensor of claim 4 wherein said pin is made of magnesium.

6. The sensor of claim 1 wherein said pin has a pointed end which engages against an end wall of the sleeve.

7. The sensor of claim 6 wherein said point of said pin is made of soft metal which, when coolant additive is depleted, is corroded away to break contact with the brass sleeve.

8. The sensor of claim 7 wherein said pin is adjustably threadedly engaged within said insert to reset the pin point against the brass wall when contact therebetween is broken.

9. The sensor of claim 1 wherein said pin has means thereon which are engageable by a tool for use in rotating same.

10. In a circuit for indicating when coolant additive is depleted from an engine cooling system, a sensor mounted with the circuit and having a first ground-forming component and a second path-forming component which are in contact with one another at a single point to form an electrical path therethrough, the point of contact therebetween being disposed within the engine coolant system and the path-forming component being made of a corrodible material such that, upon said coolant additives becoming depleted, the coolant corrodes the contact point of the path-forming component, breaking said electrical path wherein said first ground-forming component is a hollow brass sleeve having an end wall and having flow passages into an interior thereof adjacent said end wall.

11. The circuit of claim 10 wherein a nylon insert is engaged within said hollow brass sleeve and extends therewithin to a position adjacent said flow passages.

12. The circuit of claim 11 wherein said path-forming component comprises a threaded magnesium pin having a pointed end and an opposite end engageable by a tool for turning of the pin, said pointed end being seated against said end wall of said brass sleeve.

13. The circuit of claim 12 wherein said pointed end of said pin lies between said flow passages through the sleeve and wherein said flow passages are seated within a coolant flow path of said engine cooling system.

14. The circuit of claim 13 wherein said pointed end of said pin is corroded away by coolant flowing thereacross when additives therein become depleted, opening said electrical path.

15. The circuit of claim 14 when said electrical path is recloseable upon turning of said threaded pin to bring the pointed end thereof back into contact with the end wall of the brass sleeve.

* * * * *